United States Patent [19]

Schoonover

[11] Patent Number: 4,512,520

[45] Date of Patent: Apr. 23, 1985

[54] DUAL ELEMENT DESUPERHEATER APPARATUS

[75] Inventor: Kevin G. Schoonover, Tucker, Ga.

[73] Assignee: Steam Systems and Services, Incorporated, Atlanta, Ga.

[21] Appl. No.: 493,724

[22] Filed: May 11, 1983

[51] Int. Cl.[3] ..... A62C 31/00

[52] U.S. Cl. ..... 239/440; 239/440

[58] Field of Search ..... 239/390, 397, 436, 437, 239/438, 439, 443, 444, 446, 459, 465, 466, 476, 477, 482, 483, 447, 448, 563, 415, 440; 261/DIG. 13; 417/180; 122/487

[56] References Cited

U.S. PATENT DOCUMENTS

| | | | |
|---|---|---|---|
| 556,291 | 3/1896 | Turner | 239/443 X |
| 1,171,140 | 2/1916 | Robertson | 239/482 |
| 1,486,156 | 3/1924 | Needham | 239/440 |
| 1,893,298 | 1/1933 | Moore | 239/448 X |
| 2,255,688 | 9/1941 | Tavone | 239/440 |
| 2,895,682 | 7/1959 | Tavone | 239/440 X |
| 3,719,524 | 3/1973 | Ripley | 417/180 |

*Primary Examiner*—Andres Kashnikow
*Assistant Examiner*—James R. Moon, Jr.
*Attorney, Agent, or Firm*—Jones & Askew

[57] ABSTRACT

Apparatus for introducing a selectably variable flow of water to a steam line so as to reduce the superheat of the steam. The apparatus provides two separate water valve elements for controlling the flow of desuperheating water at relatively low and high volumes of water. These minor and major valve elements are concentric with each other and with the desuperheater housing, and are progressively operated by a single linear operating rod. A whirling motion is imparted to the major and minor water sprays, maximizing the surface area of each water spray and thereby providing more efficient desuperheating.

22 Claims, 8 Drawing Figures

DUAL ELEMENT DESUPERHEATER APPARATUS

FIELD OF THE INVENTION

This invention relates in general to steam desuperheater apparatus, and relates more particularly to apparatus for desuperheating steam by injecting a flow of water into a steam line.

BACKGROUND OF THE INVENTION

Steam generating or utilizing systems, such as steam boilers and turbines, frequently operate with superheated steam, or vapor at a higher temperature than the saturation temperature at a particular pressure. Because superheated steam can reach temperatures which damage the turbine or the superheater itself, it is necessary to maintain close control over the superheat temperature. Although there are several known techniques for controlling superheat temperature, one favored technique is to reduce the superheat temperature by injecting a water spray into the steam line. This water spray reduces the superheat temperature by the amount of heat required to raise the injected mass of water to the vaporization temperature and then vaporize the water.

Because of the need for close control of superheat temperatures, water spray desuperheating must be capable of injecting selectably variable amounts of water into the superheated steam. Thus, it is known that water-spray desuperheaters should be capable of throttling modulating flow over a range from the maximum water-injecting opening down to a desired minimum flow opening.

The goal of water-injecting desuperheaters is to maximize the temperature reduction obtained for a given amount of water added to the superheated steam. To attain that goal, the desuperheater should introduce water in a geometric pattern providing a homogenous flow while maximizing the surface area of the water, thereby decreasing the time required to vaporize the desuperheating water. Moreover, the desired geometric pattern of water introduced to the steam flow should be maintained at all possible throttled settings of the desuperheating valve, from maximum flow down to minimum flow, so as to provide a relatively constant correlation between the amount of water introduced at a particular setting of the desuperheater valve, and the desuperheating effect obtained at that setting.

Water-spray desuperheaters of the prior art generally have not maintained the desired geometric flow pattern over all positions of the valve, particularly at the lower-volume throttled positions. Such valves generally provide an orifice sized to introduce the maximum desired volume of desuperheat water, and this orifice can be configured to provide the desired geometric pattern of water for maximizing surface area of the water at or near the designed maximum flow rate. Such valves are throttled by partially plugging or blocking the orifice to reduce the maximum flow. These reduced flow rates are generally accompanied by a reduction in the velocity of water introduced to the superheated steam from the throttled orifice, to a point where the flow velocity becomes too low to maintain the desired geometric pattern of water dispersion provided at less-throttled positions of the valve. Consequently, water injecting desuperheaters of the prior art tend to operate less efficiently at reduced amounts of water flow.

SUMMARY OF INVENTION

Stated in general terms, the water injection desuperheater of the present invention provides more efficient and dependable desuperheating over the entire range of available water flow rates, by providing separate orifices for relatively low-flow and high-flow desuperheat requirements, instead of providing only one orifice and attempting to manipulate that orifice so as to maintain the desired geometric pattern of water at all flow settings.

Stated somewhat more specifically, the present desuperheater includes a major orifice for introducing a maximum flow of desuperheating water, and also includes one minor orifice for introducing a relatively lesser flow of water. Each orifice may be capable of being throttled downwardly from the maximum flow available to that orifice. The orifices preferably are designed so that the flow geometry of each orifice remains unchanged through the entire range of flow available to each orifice.

Stated in yet further detail, the major and minor orifices are respectively plugged by corresponding valve elements. These valve elements preferably are operated by a single linear actuator, which progressively unplugs first the minor orifice and then unplugs the major orifice in response to actuator movement. The position of the actuator along its initial stroke functions to throttle the minor flow orifice, thus providing the desired degree of desuperheat control over the low end of the overall desuperheat range; a similar throttling effect of the major flow orifice may also be attained to the extent desired. As the major orifice is progressively unplugged after the minor orifice is at its fully-unplugged or maximum flow condition, water flowing to the minor orifice is automatically blocked; in this way, the greater flow capability of the desuperheater is determined only by the geometry of the major orifice. Thus, each orifice and related structure may be designed for optimal flow rates and patterns over the range of flow volumes expected of each orifice.

Stated even more specifically, the minor flow orifice communicates with a hollow passage within the major-orifice flow control element, and the minor flow control element fits telescopically within the major flow control element to selectably block or unblock the minor orifice. An initial extent of actuator movement causes only the minor flow control element to move, the major flow control element being held shut. Water flows to the minor orifice through at least one passage in the major element, and this passage preferably is configured to impart a whirling movement to water moving through the passage. These passages become blocked as the major element is moved to open the major orifice, thereby cutting off further water flow to the minor orifice until the actuator is operated to retract the major valve element.

Both the major and minor flow orifices, when open, communicate with separate chambers receiving a flow of water, preferably in a whirling pattern as previously mentioned. The fluid flow capacity of each chamber preferably exceeds the capacity of the respective flow orifice, with the result that the liquid accelerates in passing from the chamber through the particular orifice. This acceleration effect helps maintain the desired geometric pattern of water introduced to the superheated steam, and this acceleration coupled with the constant geometry of each orifice helps maintain the desired pattern of flow as the orifices are throttled.

Accordingly, it is an object of the present invention to provide an improved water injecting desuperheater.

It is another object of the present invention to provide a desuperheater capable of maintaining efficient use of desuperheating water as the desuperheater is throttled.

It is still another object of the present invention to provide a desuperheater capable of maintaining efficient operation at relatively low water flow volumes, yet capable of relatively higher flow rates.

The foregoing and other objects and advantages of the present invention will become more readily apparent from the following description of a preferred embodiment.

DESCRIPTION OF PREFERRED EMBODIMENT

Figure 1:
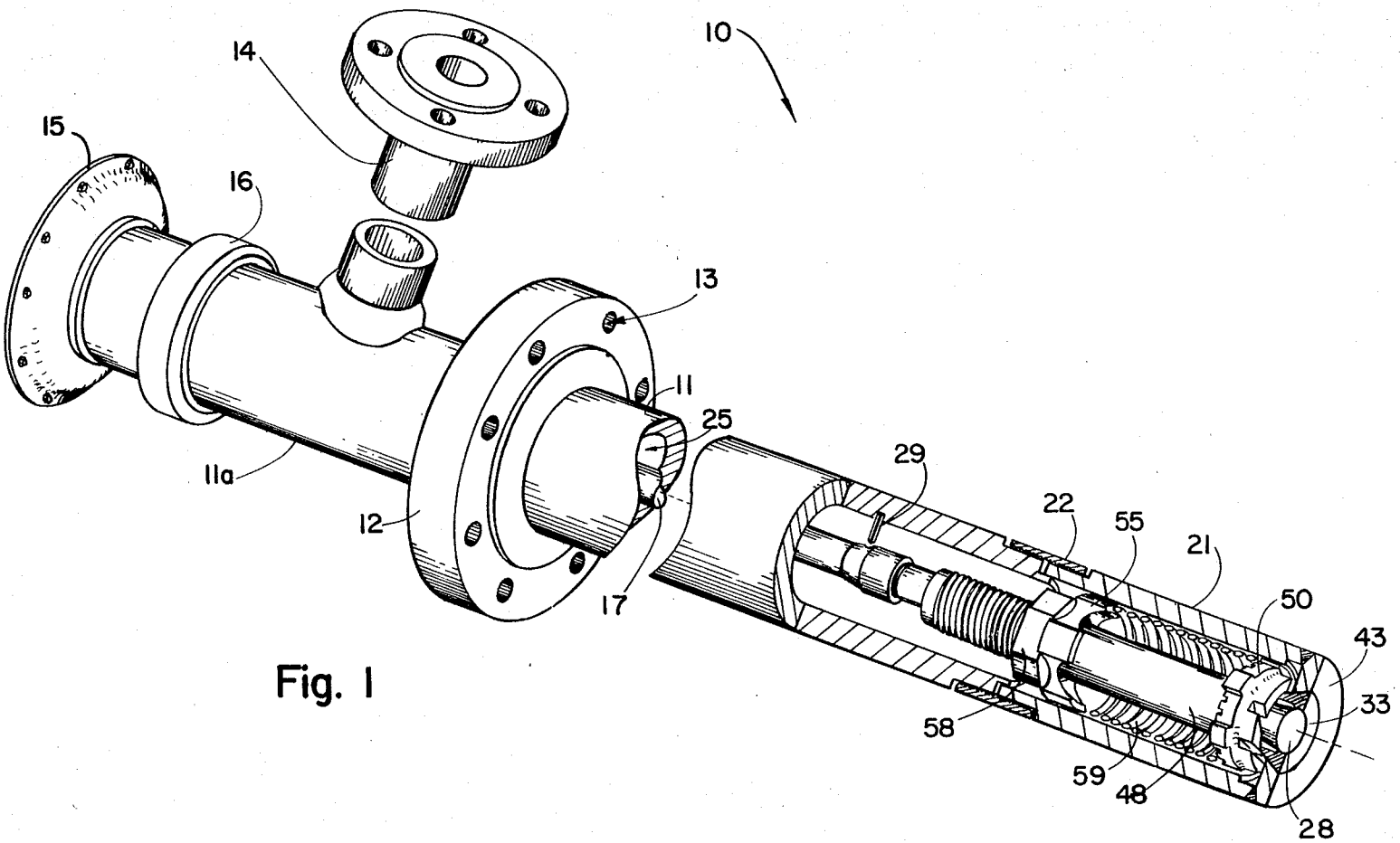
FIG. 1 is a pictorial view, partially broken away for illustration, showing a dual element desuperheater according to a preferred embodiment of the present invention.
Figure 2A:
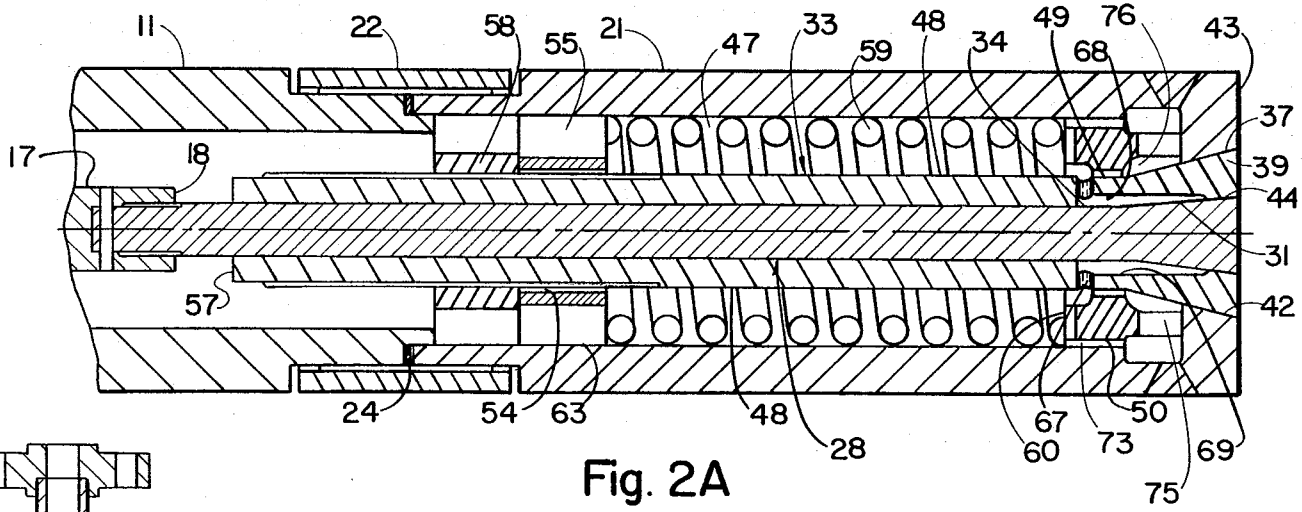
FIG. 2A is an enlarged section view showing only a portion of the apparatus in FIG. 2.
Figure 2:
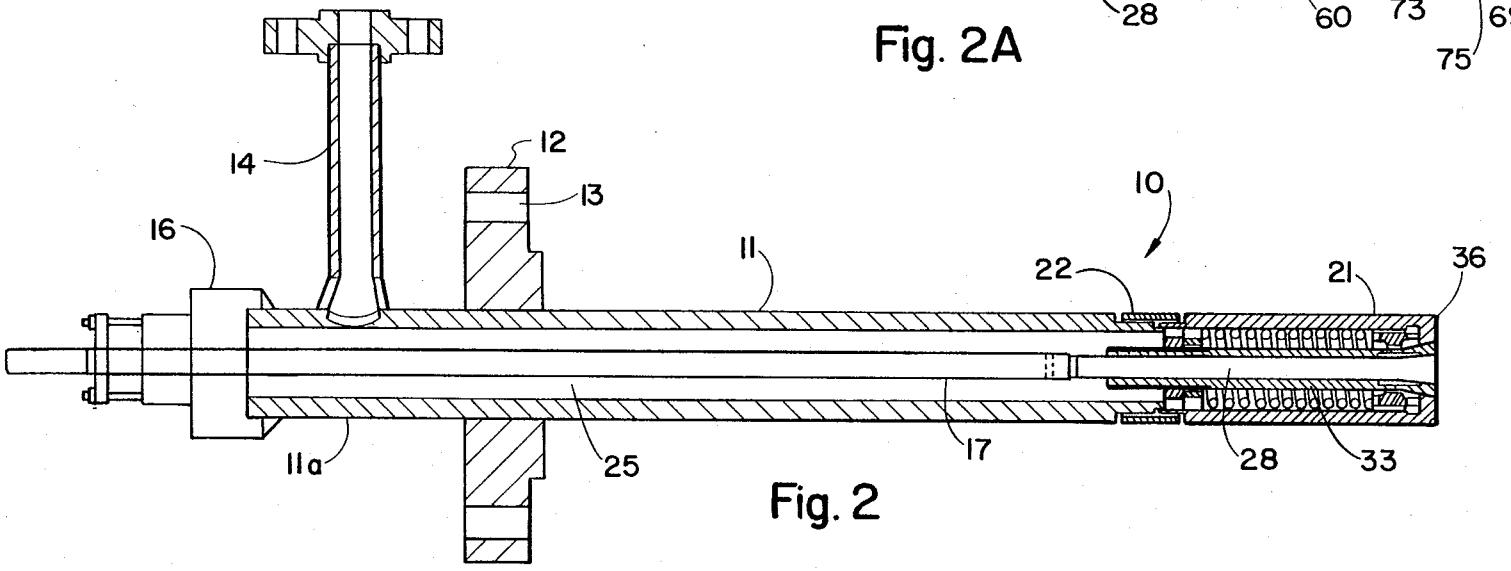
FIG. 2 is a longitudinal section view of the embodiment shown in FIG. 1.

Referring initially to FIGS. 1 and 2, there is shown generally at 10 a dual element desuperheater comprising a body pipe 11 extending through a mounting flange 12 secured to the body pipe by suitable means such as welding or the like. A number of holes 13 parallel to the body pipe 11 are formed in the mounting flange 12 around the periphery, to secure the mounting flange to a suitable fitting on a steam pipe (not shown) or the like to which the desuperheater 10 is mounted. When so mounted, those skilled in the art will understand that the portion of body pipe 11 to the right of the mounting flange 12, as viewed in FIGS. 1 and 2, becomes disposed within the steam pipe, and the portion 11*a* of the body pipe extending leftwardly from the mounting flange 12 remains outside the steam pipe. The body pipe 11 is hollow, and is connected to receive a suitable supply of water through the inlet pipe 14.

A linear actuator 15 is attached at the back end 16 of the body pipe 11, and is coupled to push or pull the main operating rod 17 extending within the body pipe. The linear actuator 15 may be any suitable device, such as an air-powered diaphragm motor or the like, imparting a selectively variable linear pushing or pulling force to the operating rod 17. A suitable position transducer (not shown) may be connected to the operating rod 17 or the linear actuator 15 to sense the position of the operating rod, if necessary for a feedback loop or other control purposes.

Attached to the forward end of the body pipe 11 is another section of hollow pipe comprising the spray head 21. An internally threaded connector ring 22, best seen in FIG. 3, engages the confronting threaded ends of the body pipe 11 and the spray head 21, securing together those two elements in closely-fitting relation. To insure a water tight assembly, the facing radial surfaces of the body pipe 11 and the spray head 21 may be serrated as shown at 23. These confronting serrated faces engage the opposite radial faces of the resilient seal member 24 within the connector ring 22, maintaining a good water tight connection between the body pipe and the spray head.

Turning to FIG. 2, the operating rod 17 is seen to extend coaxially through the body pipe 11. The diameter of the operating rod 17 is less than the interior cross-section area of the body pipe 11, leaving a substantial annular space 25 within the body pipe to receive water admitted through the inlet pipe 14. Thus, the operating rod 17 is free to undergo an extent of axial movement within the body pipe 11, in response to operation of the linear actuator 15.

The forward end of the operating rod 17 is coupled to the back end 30 of the minor valve element 28 at a location within the body pipe 11 and just behind the connector ring 22. The operating rod and the minor valve element are joined by a threaded connection at the mating ends, and this connection preferably is secured against unwanted rotation by means of a spring pin 29 forced through transverse aligned holes in the mating ends of the operating rod and the minor valve element. It will be appreciated that the hole for receiving the spring pin 29 may be drilled through the completed threaded interconnection between elements. The minor valve element 28 thus is positively coupled to the operating rod 17, and undergoes linear movement with the operating rod.

The minor valve element 28 is a solid elongated member having a back end 30 threaded to receive the forward end of the operating rod 17, and having a tapered forward end 31 forming a truncated cone with the base or larger-diameter end outermost. The minor valve element 28 is axially and slidably disposed within the interior 32 of the major valve element 33, which in turn is coaxially received within the spray head 21. The minor valve element 28 and the major valve element 33 thus are telescopically disposed within the spray head 21, and it will become apparent that both valve elements are mounted for linear travel within the spray head. Moreover, the minor vave element 28 under some circumstances can undergo linear movement relative to the major element 33. Both the major and minor valve elements are progressively operated in response to linear movement of the operating rod 17, and these valve elements control the major and minor flows of desuperheating water in a manner explained below.

The outer end of the spray head 21 terminates at the spray head cap 36, preferably a separate element which may be secured to the spray head by welding or the like. The cap 36 is penetrated by an opening 37 defining a truncated cone surface coaxial with the major valve element 33. The forward end 39 of the major valve element 33 tapers to form a truncated cone 38 shaped to complement the taper of the opening 37 in the spray head cap 36. Thus, as best seen in FIGS. 2 and 2A, the opening 37 in the cap 36 is completely plugged by the truncated cone at the forward end 39 of the major valve element, so that the forward end 39 comprises a valve for what will be seen to be the major flow orifice 37 of the desuperheater 10.

The outer face 42 of the major valve element forward end 39 preferably is radial, providing flush alignment with the face 43 of the spray head cap 36. Extending through the face 42 and coaxially aligned with the interior 32 of the major valve element 33 is the opening 44, defined by a tapered surface forming a truncated-cone shape which complements the shape of the tapered surface formed at the forward end 31 of the minor valve element 28. The forward end 31 of the minor valve element 28 can completely plug the opening 44 in the major valve element, and it will be seen that the forward end 31 thus selectably and variably plugs or unplugs the minor flow orifice 44 of the desuperheater 10.

Figure 5:
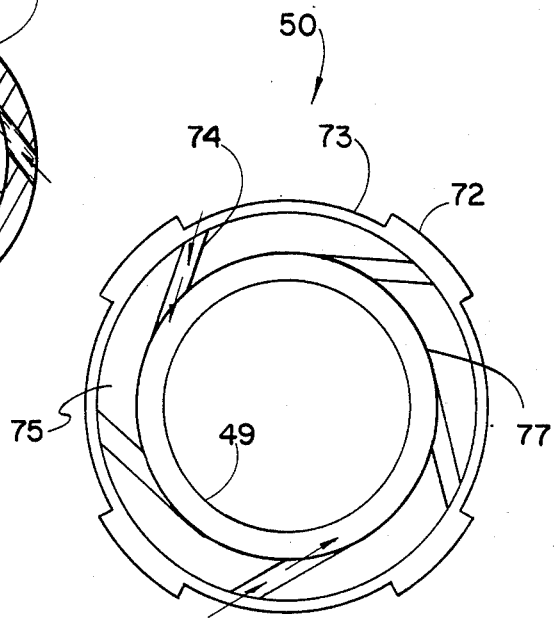
FIG. 5 is an elevation view taken from position 5—5 of FIG. 3, showing only the whirl ring in the disclosed embodiment.

The major valve element 33 is supported within the interior 47 of the spray head 21 for linear movement along the axis of the spray head. The major valve element 33 has an elongated cylindrical body 48 whose diameter is substantially less than the diameter of the spray head interior 47. The forward end of the body 48 is a close sliding fit within the bearing surface 49 (FIG. 5) of the whirl ring 50, located at the forward end of the interior 47 immediately behind the spray head cap 36. The whirl ring 50 helps support the major valve element 33 for linear movement within the spray head 21, and journals the major valve element for sliding movement relative to the spray head and the opening 37 in the cap 36.

The major valve element 33 slidably fits through an opening 54 in the load ring 55, located along the threaded portion 56 of the major valve element extending forwardly from the rear end 57. Although the load nut 58 fits over the threaded portion 56, the opening 54 of the load ring is not threaded and the load ring is freely slidable with respect to the body 48 of the major valve element. The load nut 58 engages the threaded portion 56 behind the load ring 55, and retains the load ring against the back end of the compression spring 59 which surrounds the body 48 of the major valve element 33. The forward end of the spring 59 contacts the back side 60 of the whirl ring 50, as best seen in FIG. 2A. The force of the spring 59 on the load ring 55 thus is transferred to the major valve element 33 by the load nut 58, urging the major valve element inwardly relative to the spray head 21 and thereby urging the forward end 39 of the major valve element to plug the major flow opening 37. The amount of linear closing force exerted on the major valve element by the spring 59 is adjusted by the position of the load nut 58 along the threaded portion 56 of the major valve element.

Figure 3:
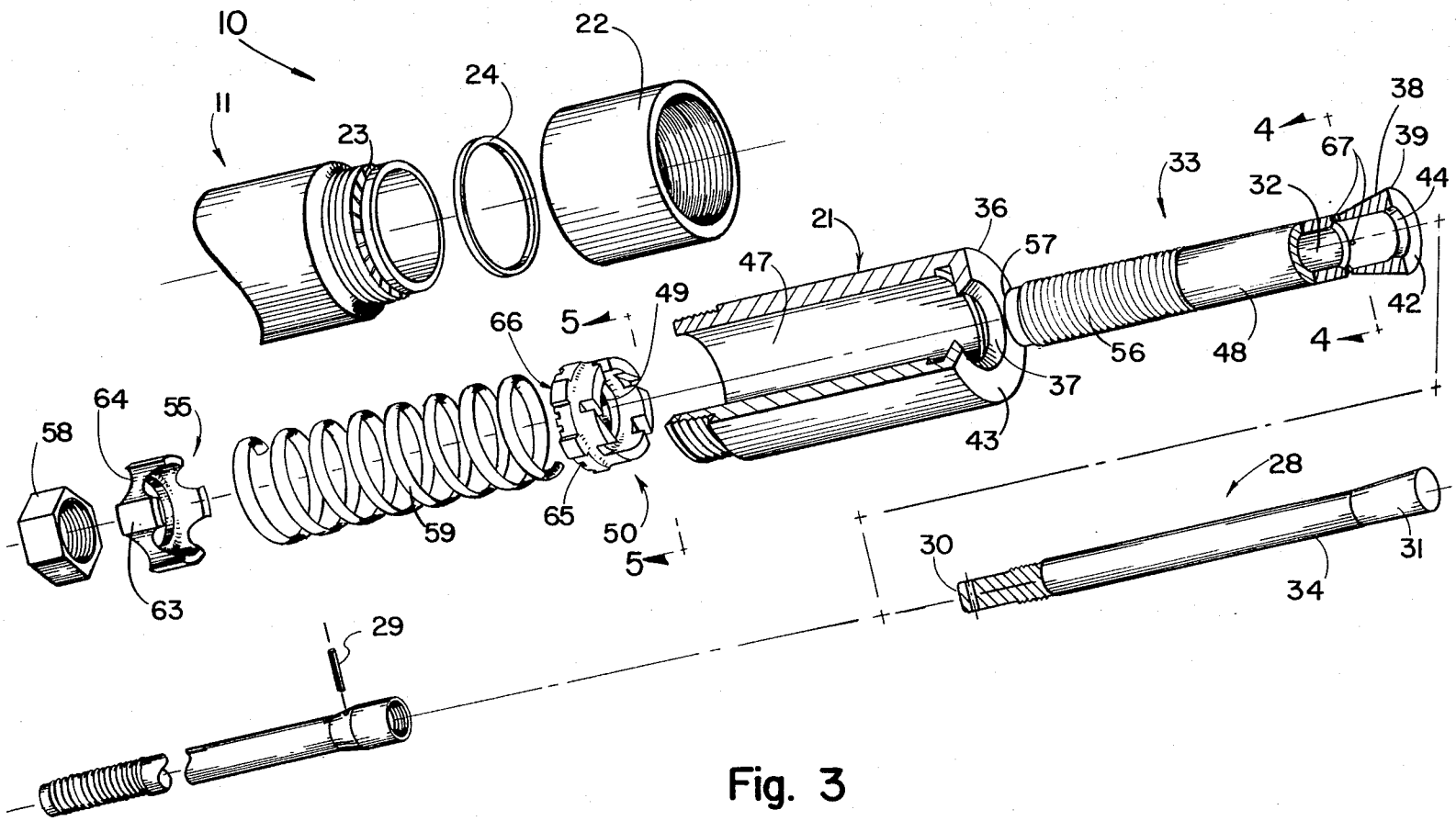
FIG. 3 is an exploded view of the disclosed embodiment.

The outermost surface 63 of the load ring 55 is a close sliding fit within the interior 47 of the spray head 21, and so the load ring centers and supports the major valve element 33 for linear movement within the spray head. As best seen in FIG. 3, a number of fluted recesses 64 are formed around the exterior of the load ring 55. These recesses 64 provide liquid communication paths between the interior 47 of the spray head 21 and the space 25 within the body pipe 11, and the recesses thus form part of the water flow channel to the spray head.

Figure 4:
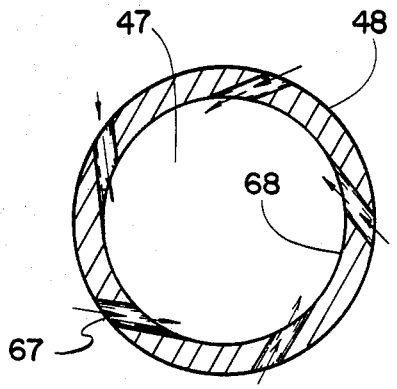
FIG. 4 is a section view taken along line 4—4 of FIG. 3, showing the water flow passages through the major element.

A number of openings 67, FIGS. 3 and 4, are formed through the body 48 of the major valve element 33 near the forward end of the body. These openings 67 provide the liquid flow path from the interior 47 of the spray head 21, to the minor flow opening 44 in the forward end of the major valve element. As best seen in FIG. 4, the openings 67 are substantially tangential to the inside surface 68 of the interior 47, imparting a whirling motion to water flowing through those openings.

The openings 67 communicate with a chamber 69, FIG. 2A, located at the forward end of the major valve element 33 and communicating with the minor flow element 28 formed therein. The chamber 69 is seen to be an annular volume defined in part by the inside surface 68 of the major element 33 at the forward end of the interior 32, and in further part by the shank 34 of the minor valve element 28 and the portion of the tapered end surface 31 spaced apart from the inside surface 68. The liquid flow carrying capacity of the chamber 69 preferably is somewhat greater than the maximum flow-handling capability of the opening 44 when unplugged by the minor valve element 28, as explained below. The whirl ring 50, held at the forward end of the spray head 21 by the compression spring 59, has a number of peripheral lands 72, FIGS. 3 and 5, which centralize the whirl ring within the interior 47 of the spray head. The lands 72 define corresponding channels 73 between the lands, and these channels provide liquid flow passages extending to the forward side of the whirl ring. After flowing through the channels 73, the water enters the several slots 74 formed through the ring member 75 on the forward side of the whirl ring 50, leading to the chamber 76 in communication with the major flow opening 37 in the spray head cap 36. The several slots 74 are tangential to the inside forward surface 77 of the ring member 75, imparting a circular whirling movement to water flowing through the slots. The chamber 76 is defined in part by the tapered surface at the forward end 39 of the major valve element 33, and in part by the inside surface 77 of the whirl ring 75.

The operation of the desuperheater 10 is now considered. It is initially assumed that the inlet pipe 14 is connected to a suitable water supply and the operating rod 17 is held to a leftmost position by the actuator 15. The minor flow opening 44 thus is plugged by the forward end 45 of the minor valve element 28, and the spring 59 holds the major valve element 33 to plug the major opening 37.

Figure 6:
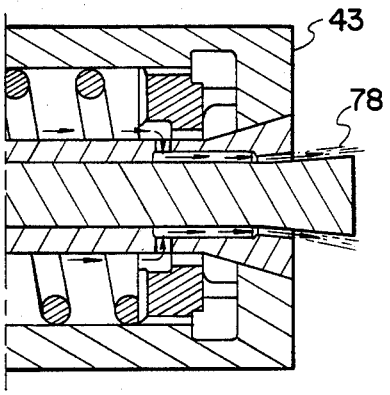
FIG. 6 is a fragmentary section view showing the minor valve element open.

The introduction of desuperheating water is initiated by operating the actuator 15 to move the operating rod 17 to the right. The movement of the operating rod 17 is directly coupled to the minor valve element 28, moving the tapered surface at the forward end 39 away from the complementary tapered surface of the opening 37. A liquid flow passage through the minor opening 37 thus is established as shown in FIG. 6, this flow passage including the openings 67 through the major element 33, the chamber 69, and the unplugged portion of the opening 37. Liquid spray 78 thus flows outwardly from the forward face 43 of the spray head 21. Because the tangential openings 67 through the major valve element 33 impart a whirling movement to the water entering the chamber 69, the liquid spray 78 introduced to the superheated steam likewise has a whirling approximately cone-shaped pattern which maximizes the surface area of the water spray and thus optimizes the desuperheating effect per unit mass of water.

The unplugged volume of the minor flow opening 37 may be modulated or throttled by appropriate linear movement of the operating rod 17 directly coupled to the minor valve element 28. Because the minor flow opening is defined by the complementary tapered surfaces of the minor valve element outer end 31 and the minor flow opening 37, the geometry of the unplugged minor flow opening is not changed by throttling adjustment of the minor valve member 28. Moreover, the liquid flow capacity of the chamber 69 preferably exceeds the maximum flow capacity the minor opening 44, thereby maintaining across the unplugged minor flow opening a differential pressure sufficient to accelerate flow through the minor opening 44 and thereby maintain the desired geometric pattern of the liquid spray 78 at any available opening of the minor flow valve.

The minor flow valve becomes fully open as the actuator 15 moves the forward end 18 of the operating rod 17 into contact with the rear end 57 of the major valve element 33. If a greater flow of desuperheat water is required, further movement of the operating rod 17 by the actuator 15 forces the major valve element 33 to the right in opposition to the spring 59. The tapered forward end 39 of the major element 33 thus moves to unplug the opening 37 in the spray head cap 36, opening the major flow path for desuperheating water. This flow path, shown in FIG. 7 and culminating in the major water spray 79, includes the channels 73 around the exterior of the whirl ring 50, the tangential whirl-inducing slots 74 in the whirl ring, and the chamber 76 located immediately behind the major flow opening 37. A plurality of radial slots 65 are formed in the back side 66 of the whirl ring 50 coincident with the channels 73 between the lands 72. These slots 65 provide alternate flow paths leading to the channels 73 in case those channels are obstructed by the forward end of the spring 59 during assembly.

Figure 7:
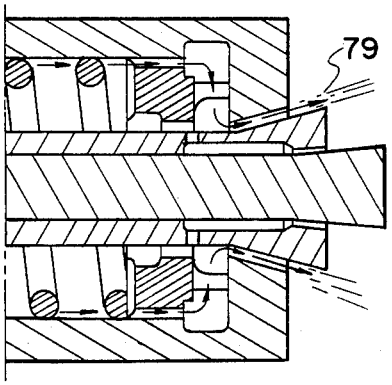
FIG. 7 is a fragmentary section view showing both the minor and major valve elements open, and flow cut off to the minor flow orifice.

As the major flow opening 37 becomes unplugged by rightward movement of the major valve element 33, the minor flow openings 67 in the major valve element become blocked as these openings move behind the bearing surface 49 of the whirl ring. Liquid flow to the minor opening 44 thus is cut off, leaving only the water spray 79 from the major opening as illustrated in FIG. 7. The major water spray 79 has a whirling movement imparted by the tangential slots 74 in the whirl ring 50, and has a conic shape imparted by the confronting complementary tapered surfaces of the major valve element forward end 38 and the opening 37. Moreover, the flow capacity of the chamber 76 immediately behind the opening 37 operates to accelerate the flow of water through that opening, maintaining the desired geometric pattern of the major water spray 79. The volume of water spray 79 is determined by the extent to which the opening 37 is unplugged by movement of the major valve element 33.

When the operating rod 17 is retracted by the actuator, the spring 59 forces the major valve element 33 to follow the retracting operating rod. Sufficient leftward movement of the operating rod 17 thus replugs the major flow opening 37 and unblocks the flow openings 67 to resume the water spray 78 through the still-unplugged minor flow opening 44. Further leftward travel of the operating rod 17 pulls the tapered end 31 of the mior valve element 28 toward the opening 44, throttling or completely plugging that opening.

It will thus be seen that both major and minor flows of desuperheating water are initiated and modulated by the progressive movement of a single operating member along a path, in response to one linear actuator. Depending on the particular geometry of the valves and the extent of lost-motion provided by the confronting surfaces 18 and 57 of the operating rod and the major valve element 33, the amount of the total actuator stroke which throttles the minor valve element may be selected. In a specific example of desuperheater according to the present invention approximately 67% of the operating rod stroke controls liquid flow through the minor flow opening. This arrangement permits closer and more precise control where relatively small amounts of desuperheating are required.

It should also be understood that the foregoing relates only to preferred embodiment of the present invention, and that numerous changes and modifications may be made therein without departing from the spirit and scope of the invention as defined in the following claims.

I claim:

1. Apparatus for introducing a variable flow of fluid into a body, comprising:

a housing having an injection region locatable in the body, and having an interior chamber operable to receive a supply of fluid;

a primary flow control element within said housing and selectably operaive to open a primary fluid flow orifice leading to said injection region;

a secondary flow control element within said housing concentric to said primary flow control element and selectably operative to open a secondary fluid flow orifice leading to said injection region; and means associated with said secondary flow control element to operate said primary flow control element after said secondary fluid flow orifice is opened, and to block fluid flow through the opened secondary fluid flow orifice when said primary fluid flow orifice is open, so that the fluid can flow only through said primary orifice when both said primary and second orifices are opened.

2. Apparatus as in claim 1, further comprising:

actuating means selectably movable within said housing to progressively open one and then the other of said orifices.

3. Apparatus for introducing a variable flow of fluid into a region, comprising:

a housing having an introduction region locatable in said region, and having an interior chamber operable to receive a supply of fluid;

a primary flow control element within said housing and selectably operative to establish a primary fluid flow orifice leading to said injection region;

a secondary element within said housing concentric to said primary flow control element and selectably operative to establish a secondary fluid flow orifice leading to said injection region;

operating means progressively operable to initiate fluid flow from said introduction region by initially opening said secondary element to establish said secondary orifice, selectably followed by opening said primary element to establish said primary orifice; and valve means operative in response to opening said primary element to block said fluid flow to said open secondary orifice, so that the fluid can flow only from said primary orifice whenever said operating means has progressively opened both said primary and secondary flow control elements.

4. Apparatus as in claim 3, wherein:

said operating means comprises an actuating member operative for reciprocal travel along a path within said housing; and said actuating member operative to move only said secondary element when traversing a first portion of said path, and move both said primary and secondary elements when traversing a second portion of said path, whereby both of said flow control elements and said valve means are progressively controlled by progressively traversing first and second portions of said path.

5. Apparatus as in claim 4, wherein:

said secondary element is coaxial with said primary element, and moves relative to said primary element when traversing said first portion of the path; and further comprising means maintaining said primary element closed while said actuating means traverses said first portion of the path.

6. Apparatus as in claim 4, wherein:

said secondary element is coaxially disposed for movement in telescopic relation to said primary element;

said primary element moves relative to said housing as said actuating means traverses said second portion of said path; and said valve means comprises at least one fluid flow passage extending through said primary element for flow communication with said secondary flow orifice, and means positioned to prevent flow through said flow passage as said primary element moves relative to said housing.

7. Apparatus as in claim 3, wherein:

said primary element moves relative to said housing as said operating means opens said primary element to establish said primary orifice; and said valve means comprises at least one fluid flow passage in said primary element for flow communication with said secondary flow orifice; and means positioned to prevent flow through said passage as said primary element moves to open said primary orifice, whereby fluid flow to said secondary orifice thereby is blocked.

8. Apparatus for injecting a variable flow of desuperheating liquid into a body containing superheated steam, comprising:

housing means connectable to receive a supply of liquid and having a surface in communication with the body;

first valve means and second valve means within said housing means, each said valve means being selectably operable to define corresponding first and second liquid dispensing passages in said housing surface;

operating means associated with said first and second valve means and selectably operative to progressively open said first and second liquid dispensing passages; and flow control means operative in response to opening said second passage to block liquid flow in said housing to said first passage, so the liquid flows into said region from only said second dispensing passage whenever both said dispensing passages are open.

9. Apparatus as in claim 8, wherein said operating means comprising:

an operating member movable along a path and coupled to said first valve means; and means defining a lost-motion engagement with said second valve means so as to commence opening said second passage only after said operating member has traversed a certain portion of said path.

10. Apparatus as in claim 9, wherein:

said first and second valve means are concentric with each other within said housing means; and further comprising means yieldingly urging said second valve means closed in opposition to said operating member.

11. Apparatus for introducing a variable flow of fluid into a body, comprising:

housing means having an internal chamber and having wall means for locating in the body;

an opening formed in said wall means in communication with the internal chamber of said housing means;

first flow control means movably disposed in said housing means and having a first control element cooperating with said opening so as to selectably block or unblock the opening in response to movement of said first flow control means, so that said opening and said first control element cooprate to provide a first fluid flow orifice for introducing a flow of fluid to said region;

second flow control means coaxial with said first flow control means and movably disposed in said housing means;

said second flow control means having a second flow control element selectably operative to provide a second fluid flow orifice for introducing a flow of fluid through said wall means to said region; and means communicating a supply of fluid to said internal chamber for said orifices, so that a variable flow of the fluid may be selectably admitted to said region through either said first or second orifice, depending on the operation of said first and second flow control means.

12. Apparatus as in claim 11, wherein:

said first flow control means is mounted for reciprocating movement relative to said housing means, so as to move said first control element outwardly from said wall means to unblock said opening when the first flow means moves in a selected direction; and said second flow control means is carried by said first flow control means and is selectably operative to move relative to said first control element, thereby opening said second flow control element.

13. Apparatus as in claim 12, further comprising:

a passage defined in said first flow control element to receive said second flow orifice in said first flow control element; and said second flow control element being movably disposed in said passage so as to selectably unblock said second orifice for admitting the fluid therethrough.

14. Apparatus as in claim 13, further comprising:

operating means in said housing and selectably operative to introduce said variable flow by initially moving said second flow control means relative to said first flow control means, thereby opening said second orifice, and by then moving said first flow control means relative to said housing means, thereby opening said first orifice.

15. Apparatus as in claim 14, wherein:

the fluid flows to said second orifice along a path including aperture means communicating with said passage in said first flow control element; and further comprising means within said housing means in fixed position relative to said first flow control element, and operative to block said aperture means as said first flow control means to open said first orifice, so that the fluid can flow only from said first orifice although both said orifices may be open at the time.

16. Desuperheating apparatus for introducing a variable flow of fluid to a structure containing superheated steam, comprising:

housing means having a body defining an internal chamber and an end wall locatable in fluid flow communication with the structure;

a first opening in said wall;

first flow control member movably disposed within said chamber in spaced relation to said body;

said first flow control member connected to a first valve member cooperating with said first opening to selectably block or unblock said first opening in response to movement of said first flow control member, thereby selectably introducing a first quantity of fluid to said region;

an elongated passage formed in said first flow control member;

one end of said passage being in communication with an opening in said first valve member, said opening comprising a second opening in said wall;

a second flow control member movably disposed in said elongated passage;

said second flow control member connected to a second valve member cooperating with said second opening to selectably block or unblock said second opening in response to movement of said second control member relative to said first control member, thereby selectably introducing a second quantity of fluid to said region; and means associated with said second fluid flow control member to operate said first fluid flow control member for unblocking said first opening after said second opening is unblocked, and to prevent further fluid flow from said unblocked second opening when said first opening is unblocked, so that the fluid can flow from said first opening when both said first and second openings are unblocked.

17. Apparatus as in claim 16, further comprising:

actuating means located in said housing means and operable to move a selectably variable extent according to the desired flow of fluid to said region; and said actuating means being operatively associated with said first and second flow control members to move said second flow control member relative to said first flow control member for unblocking said second opening in response to a first extent of movement, and to move said first flow control member relative to said body for unblocking said first opening in response to a second extent of movement, whereby said actuating means progressively actuates said second and first openings.

18. Desuperheating apparauts for introducing a variable flow of fluid to region containing superheated steam, comprising:

housing means having a body defining an internal chamber and an end wall locatable in fluid flow communication with said region;

a first opening in said wall;

first flow control member movably disposed within said chamber in spaced relation to said body;

said first flow control member connected to a first valve member cooperating with said first opening to selectably block or unblock said opening in response to movement of said first flow control member, thereby selectably introducing a first quantity of fluid to said region;

an elongated passage formed in said first flow control member;

one end of said passage being in communication with an opening in said first valve member, said opening comprising a second opening in said wall;

a second flow control member movably disposed in said elongated passage;

said second flow control member connected to a second valve member cooperating with said second opening to selectably block or unblock said second opening in response to movement of said second control member relative to said first control member, thereby selectably introducing a second quantity of fluid to said region;

said body receiving the fluid to be introduced to said region, whereby the fluid is introduced to said body in the space between the body and said first flow control member;

means defining a fluid receiving chamber communicating with said second opening in said first valve member;

at least one opening in said first flow control member to admit fluid to said chamber from said space, so that the fluid can flow from said chamber through said second opening when unblocked; and means disposed to obstruct fluid flow through said at least one opening in said first flow control member as the first flow control member moves to unblock said first opening, whereby fluid flow from said second opening is cut off even though said second opening remains unblocked.

19. Apparatus as in claim 18, wherein:

the fluid flow capacity of said chamber exceeds the corresponding capacity of said second opening when unblocked, so as to accelerate the flow of fluid through the second opening.

20. Apparatus as in claim 18, wherein:

said at least one opening in said first flow control member is operative to impart a whirling flow of fluid admitted to said chamber, so as to provide a whirling fluid flow to said region from said second opening.

21. Apparatus as in claim 18, wherein:

said chamber communicating with said second opening is one such chamber; and further comprising means defining another fluid receiving chamber communicating with said first opening in said valve member;

means defining at least one fluid flow passage to admit fluid to said other chamber from said space so that fluid can flow from said other chamber through said first opening when unblocked; and the fluid flow capacity of said other chamber exceeds the corresponding capacity of said first opening when unblocked, so as to accelerate the flow of fluid through said second opening.

22. Apparatus as in claim 21, wherein:

said fluid flow passage defining means is operative to impart a whirling flow of fluid admitted to said other chamber, so as to provide a whirling fluid flow to said region from said first opening.

* * * * *